US010070240B2

(12) United States Patent
Liu et al.

(10) Patent No.: US 10,070,240 B2
(45) Date of Patent: Sep. 4, 2018

(54) METHODS AND APPARATUSES FOR CONTROLLING AN AUDIO SYSTEM

(71) Applicant: Shenzhen Skyworth-RGB Electronic Co., Ltd., Shenzhen (CN)

(72) Inventors: Xiangzhang Liu, Shenzhen (CN); Wensheng Hong, Shenzhen (CN); Qi Zhang, Shenzhen (CN)

( * ) Notice: Subject to any disclaimer, the term of this patent is extended or adjusted under 35 U.S.C. 154(b) by 0 days.

(21) Appl. No.: 15/495,001

(22) Filed: Apr. 24, 2017

(65) Prior Publication Data

US 2017/0230773 A1 Aug. 10, 2017

Related U.S. Application Data

(63) Continuation of application No. PCT/CN2016/083127, filed on May 24, 2016.

(30) Foreign Application Priority Data

Nov. 18, 2015 (CN) ..... 2015 1 0799222

(51) Int. Cl.

| | |
|---|---|
| ***H04S 3/00*** | (2006.01) |
| ***H04R 5/02*** | (2006.01) |
| ***H04R 5/04*** | (2006.01) |
| ***H04S 7/00*** | (2006.01) |

(52) U.S. Cl.

CPC ..... *H04S 3/008* (2013.01); *H04R 5/02* (2013.01); *H04R 5/04* (2013.01); *H04S 7/30* (2013.01); *H04S 2400/13* (2013.01)

(58) Field of Classification Search

CPC ..... H04S 3/008; H04S 7/30; H04S 2400/13; H04R 5/02; H04R 5/04

USPC ..... 381/303, 300, 307, 310, 58, 59

See application file for complete search history.

(56) References Cited

U.S. PATENT DOCUMENTS

2012/0099741 A1* 4/2012 Gotoh ..... H03G 9/18 381/119

2014/0202318 A1 7/2014 Ohnishi et al.

FOREIGN PATENT DOCUMENTS

| | | | | |
|---|---|---|---|---|
| CN | 2471044 Y | | 1/2002 | |
| CN | 202197394 U | | 4/2012 | |
| CN | 102456350 A | * | 5/2012 | ..... H03G 9/18 |
| CN | 104994459 A | | 10/2015 | |

(Continued)

*Primary Examiner* — Melur Ramakrishnaiah

(74) *Attorney, Agent, or Firm* — Wayne & King LLC

(57) ABSTRACT

A method of controlling an audio system is disclosed, the method including: obtaining initialization configuration parameters and the identification information of each of the power amplifiers, and initializing the respective power amplifiers by the configuration parameters according to the identification information so as to obtain a corresponding frequency range of each of the power amplifiers; and when the audio data is acquired, transferring the audio data to the respective power amplifiers, so that each of the power amplifiers receives the audio data, performs digital-to-analog conversion of the audio data according to the corresponding frequency range, and further outputs the digital-to-analog converted audio data to the corresponding speaker. An apparatus for controlling an audio system is also disclosed. The present disclosure improves the sound quality of the digital television audio system and reduces the cost of the digital television audio system.

18 Claims, 4 Drawing Sheets

(56) References Cited

FOREIGN PATENT DOCUMENTS

CN 105338448 A 2/2016

* cited by examiner

METHODS AND APPARATUSES FOR CONTROLLING AN AUDIO SYSTEM

CROSS-REFERENCE TO RELATED APPLICATIONS

This application is a continuation of International Patent Application No. PCT/CN2016/083127 with a filing date of Mar. 24, 2016, designating the United States, now pending, and further claims priority to Chinese Patent Application No. 201510799222.9 with a filing date of Nov. 18, 2015, designating the United States, now pending. The content of the aforementioned applications, including any intervening amendments thereto, are incorporated herein by reference.

TECHNICAL FIELD

Embodiments of the present disclosure relate generally to audio technology, and more particularly to methods and apparatuses for controlling an audio system.

BACKGROUND OF THE PRESENT INVENTION

Nowadays, with the improvement of people's living standard, the requirements for digital TV are getting increasingly higher. Among them, the digital TV audio system is one of the important indices of digital TVs. Most of the digital TV audio systems currently employ one power amplifier to drive the left channel and the right channel to achieve the most basic audio output. While only one power amplifier can be used to achieve the most basic left channel and right channel audio output, the bass part and the treble part of the audio may not be able to attain a good sound quality. At present, a small number of digital TV audio systems use two power amplifiers to drive the left channel, the right channel, and the bass to achieve 2.1-channel audio output. However, the output of the bass part may require an external subwoofer, while the sound quality of the treble part may still be inadequate, resulting in a poor overall sound quality. In addition, the crossover may also be required to separate the mid- and high-range frequencies, which adds to the cost.

The foregoing is for the sole purpose of assisting readers in understanding the solution of the present disclosure and is not meant to recognize the above contents as the prior art.

SUMMARY OF PRESENT INVENTION

It is the primary objective of the present disclosure to provide methods and apparatuses for controlling an audio system in order to solve the problem that the sound quality of conventional digital TV audio systems ends up poor and costly.

To the above end, there is provided a method of controlling an audio system that includes at least two power amplifiers, the method including:

Obtaining initialization configuration parameters and identification information of each of the power amplifiers, and initializing the respective power amplifiers by the configuration parameters according to the identification information to obtain a corresponding frequency range of each of the power amplifiers;

When the audio data is acquired, transferring the audio data to each of the power amplifiers, and converting, by the power amplifier, the audio data from digital to analog according to the corresponding frequency range and outputting the digital-to-analog converted audio data to the corresponding speaker.

The audio system may include three power amplifiers, including a high frequency power amplifier, a mid frequency power amplifier, and a low frequency power amplifier. The high frequency power amplifier may be coupled to a left channel device and a right channel device. The mid frequency power amplifier may be coupled to the left channel device and the right channel device. The low frequency power amplifier may be coupled to a subwoofer.

Obtaining the initialization configuration parameters and the identification information of each of the power amplifiers and initializing the power amplifiers by the configuration parameters may include:

Obtaining the initialization configuration parameters and the identification information of the high frequency power amplifier, the identification information of the mid frequency power amplifier, and the identification information of the low frequency power amplifier, and initializing the low frequency power amplifier by the configuration parameters according to the identification information of the low frequency power amplifier, so as to obtain the corresponding frequency range of the low frequency power amplifier;

After obtaining the corresponding frequency range of the low frequency power amplifier, initializing the mid frequency power amplifier by the configuration parameters according to the identification information of the mid frequency power amplifier, so as to obtain the corresponding frequency range of the mid frequency power amplifier; and After obtaining the corresponding frequency range of the mid frequency power amplifier, initializing the high frequency power amplifier by the configuration parameters according to the identification information of the high frequency power amplifier, so as to obtain the corresponding frequency range of the high frequency power amplifier.

The method may further include, subsequent to transferring the audio data to each of the power amplifiers and converting, by the power amplifier, the audio data from digital to analog according to the corresponding frequency range and outputting the digital-to-analog converted audio data to the corresponding speaker:

Detecting whether there is a volume control instruction;

If there is a volume control instruction, extracting the corresponding volume data of the respective power amplifiers;

Configuring volume control data for the respective power amplifiers based on the volume data and the volume control instruction, and transferring the volume control data to the respective power amplifiers.

The method may further include, subsequent to determining whether there is a volume control instruction:

If there is no volume control instruction, detecting still whether there is a volume control instruction.

There is also provided an apparatus for controlling an audio system that includes at least two power amplifiers, the apparatus including:

an initialization module configured to obtain the initialization configuration parameters and identification information of each of the power amplifiers, and initialize the respective power amplifiers by the configuration parameters according to the identification information to obtain a corresponding frequency range of each of the power amplifiers;

a transmission module configured to transfer the audio data, if acquired, to each of the power amplifiers, so that the power amplifier may convert the audio data from digital to analog according to the corresponding frequency range and output the digital-to-analog converted audio data to the corresponding speaker.

The audio system may include three power amplifiers, a high frequency power amplifier, a mid frequency power amplifier, and a low frequency power amplifier. The high frequency power amplifier may be coupled to a left channel device and a right channel device. The mid frequency power amplifier may be coupled to the left channel device and the right channel device. The low frequency power amplifier may be coupled to a subwoofer.

The initialization module may include:

a first initialization unit configured to obtain the initialization configuration parameters and the identification information of the high frequency power amplifier, the identification information of the mid frequency power amplifier, and the identification information of the low frequency power amplifier, and so initialize the low frequency power amplifier by the configuration parameters according to the identification information of the low frequency power amplifier so as to obtain the corresponding frequency range the low frequency power amplifier;

a second initialization unit configured to initialize, after the corresponding frequency range of the low frequency power amplifier is obtained, the mid frequency power amplifier by the configuration parameters according to the identification information of the mid frequency power amplifier so as to obtain the corresponding frequency range of the mid frequency power amplifier; and a third initialization unit configured to initialize, after the corresponding frequency range of the mid frequency power amplifier is obtained, the high frequency power amplifier by the configuration parameters according to the identification information of the high frequency power amplifier so as to obtain the corresponding frequency range of the high frequency power amplifier.

The apparatus may further include:

a detection module configured to detect whether there is a volume control instruction;

an extraction module configured to extract the corresponding volume data of the respective power amplifiers, if there is a volume control instruction; and a configuration module configured to configure volume control data for the respective power amplifiers based on the volume data and the volume control instruction, and transfer the volume control data to the respective power amplifiers.

The apparatus may further include a processing module configured to detect still whether there is a volume control instruction, if there is detected no volume control instruction.

According to the solution of the present disclosure, the respective power amplifiers can be initialized according to the identification information of the power amplifiers and the acquired configuration parameters, so that the corresponding frequency range of each of the power amplifiers can be obtained. Then the acquired audio data may be transferred to the respective power amplifiers, so each of the power amplifiers can receive the audio data and perform digital-to-analog conversion of the audio data according to the corresponding frequency range and consequently output the digital-to-analog converted audio data to the corresponding speaker. Thus, the audio data of different frequency ranges can be converted from digital to analog and amplified by a plurality of power amplifiers and then outputted to the respective speakers, enabling wider frequency response of the digital TV audio system and better sound quality. In addition, the external subwoofer would not be needed for the bass, which therefore saves the cost.

The foregoing objects, features and advantages of the present disclosure will be described in further detail with reference to the accompanying drawings.

DETAILED DESCRIPTION OF PREFERRED EMBODIMENTS

It is to be understood that the specific embodiments described herein are for illustration purposes only and are not intended to be limiting the scope of the present disclosure.

A method of controlling an audio system is provided.

Figure 1:
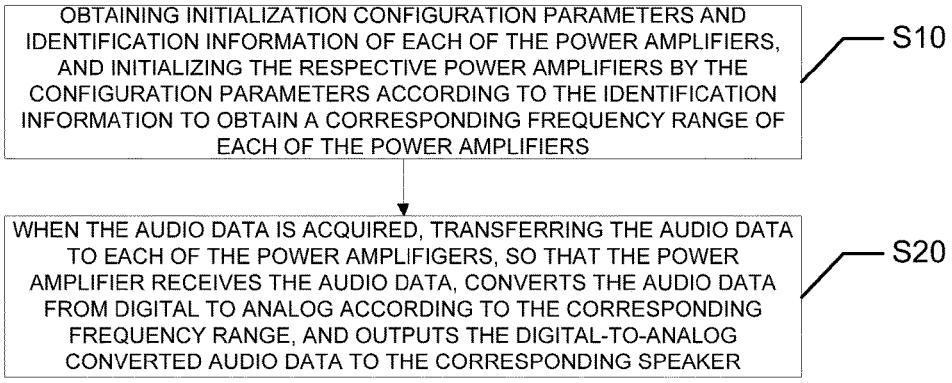
FIG. 1 shows a flowchart illustrating a first embodiment of a method of controlling an audio system according to the present disclosure.

FIG. 1 shows a flowchart illustrating a first embodiment of a method of controlling an audio system according to the present disclosure.

The audio system may include at least two power amplifiers. The method may include the following blocks.

In S10, initialization configuration parameters and identification information of each power amplifier may be obtained, and the respective power amplifiers may be initialized by the configuration parameters according to the identification information, so as to obtain a corresponding frequency range of each of the power amplifiers.

The CPU (Central Processing Unit) of the digital TV audio system may obtain the initialization configuration parameters and the identification information of each of the power amplifiers and load the configuration parameters to the respective power amplifiers through the audio data interface according to the identification information, so as to initialize the respective power amplifiers to obtain the corresponding frequency range of each of the power amplifiers. The digital TV audio system may include a main IC (integrated circuit), power amplifiers, speakers, a power supply, etc. The main IC in the present embodiment may be the CPU, which may include an I2C (Inter-Integrated Circuit) bus and an I2S (Inter-IC Sound) bus, where the I2S bus can also be called an IC built-in audio bus. The audio data interface may be composed of the I2C bus and the I2S bus in the main IC. It is appreciated that the main IC includes, but is not limited to the I2C bus and the I2S bus. The configuration parameters may include the corresponding equalizer parameters of the respective power amplifiers, the corresponding amplitude limiter parameters of the respective power amplifiers, and the like. The identification information of each of the power amplifiers may be a device address set by the hardware configuration of the power amplifier.

There may be, for example, three speakers in the present embodiment, two of which being mid and high frequency speakers, the other one being a subwoofer. Of the two mid and high frequency speakers, one may be applied for the left channel audio data, while the other applied for the right channel audio data. On the other hand, there may be three power amplifiers in the digital television, including a high frequency power amplifier, a mid frequency power amplifier, and a low frequency power amplifier. The high frequency power amplifier may be coupled both to the left channel device and to the right channel device in the speaker. The mid frequency power amplifier may also be coupled both to the left channel device and to the right channel device. The low frequency power amplifier may be coupled to the subwoofer in the speaker. For example, the corresponding device address of the high frequency power amplifier may be A, the corresponding device address of the mid frequency power amplifier may be B, and the corresponding device address of the low frequency power amplifier may be C. According to the device address A of the high frequency power amplifier, the CPU would be able to extract, among the said configuration parameters, the configuration parameters of the high frequency power amplifier, load the configuration parameters of the high frequency power amplifier through the I2C bus to the high frequency power amplifier, i.e., the high frequency power amplifier is initialized to obtain a frequency range of the audio data that can be processed by the high frequency power amplifier, which is the corresponding frequency range of the high frequency power amplifier. For instance, the corresponding audio data frequency range of the high frequency power amplifier may be in the range of higher than 1.5 kHz (kilohertz). Likewise, according to the device address B of the mid frequency power amplifier, the CPU may extract, among the said configuration parameters, the configuration parameters of the mid frequency power amplifier, load the configuration parameters of the mid frequency power amplifier through the I2C bus to the mid frequency power amplifier, i.e., the mid frequency power amplifier is initialized to obtain a frequency range of the audio data that can be processed by the mid frequency power amplifier, which is the corresponding frequency range of the mid frequency power amplifier. For instance, the corresponding audio data frequency range of the mid frequency power amplifier may be in the range of 140 Hz to 1.5 KHz. Also, according to the device address C of the low frequency power amplifier, the CPU may extract, among the said configuration parameters, the configuration parameters of the low frequency power amplifier, load the configuration parameters of the low frequency power amplifier through the I2C bus to the low frequency power amplifier, i.e., the low frequency power amplifier is initialized to obtain a frequency range of the audio data that can be processed by the low frequency power amplifier, which is the corresponding frequency range of the low frequency power amplifier. For instance, the corresponding audio data frequency range of the low frequency power amplifier may be in the range of 0 Hz to 160 Hz. The method may then proceed to S20.

In S20, when the audio data is acquired, the audio data may be transferred to the respective power amplifiers, so each of the power amplifiers may convert the audio data from digital to analog according to the corresponding frequency range and then output the digital-to-analog converted audio data to the corresponding speaker.

When the CPU acquires the audio data, the CPU may transmit the audio data to the respective power amplifiers via the I2S bus for receiving the audio data by the respective power amplifiers. When they receive the audio data transmitted by the CPU, the respective power amplifiers may perform digital-to-analog conversion of the audio data according to their respective frequency ranges and output the analog-to-digital converted audio data to the corresponding speakers. That is, the audio data may be amplified and then outputted to the respective speakers. When the high frequency power amplifier receives the audio data transmitted by the CPU, it may extract in the audio data the part of audio data that is higher than 1.5 kHz, and convert from digital to analog the audio data higher than 1.5 kHz and amplify the audio data and further output the amplified audio data to the mid and high frequency speaker. That is, the amplified data may be outputted to the left channel device and the right channel device, so the corresponding audio can be outputted from the mid and high frequency speaker. When the mid frequency power amplifier receives the audio data transmitted by the CPU, it may extract in the audio data the part of audio data that lies in the range of 140 Hz to 2 KHz, and convert from digital to analog the audio data in the range of 140 Hz to 2 KHz and amplify the audio data and further output the amplified audio data to the mid and high frequency speaker. That is, the amplified data may be outputted to the left channel device and the right channel device, so the corresponding audio can be outputted from the mid and high frequency speaker. When the low frequency power amplifier receives the audio data transmitted by the CPU, it may extract in the audio data the part of audio data that lies in the range of 0 Hz to 160 Hz, and convert from digital to analog the audio data in the range of 0 Hz to 160 Hz and amplify the audio data and further output the amplified audio data to the subwoofer. Thus, the subwoofer would output the corresponding audio.

Further, block S10 may specifically include:

Obtaining the initialization configuration parameters and the identification information of the high frequency power amplifier, the identification information of the mid frequency power amplifier, and the identification information of the low frequency power amplifier, and initializing the low frequency power amplifier by the configuration parameters according to the identification information of the low frequency power amplifier so as to obtain the corresponding frequency range of the low frequency power amplifier;

After obtaining the corresponding frequency range of the low frequency power amplifier, initializing the mid frequency power amplifier by the configuration parameters according to the identification information of the mid frequency power amplifier to obtain the corresponding frequency range of the mid frequency power amplifier; and After obtaining the corresponding frequency range of the mid frequency power amplifier, initializing the high frequency power amplifier by the configuration parameters according to the identification information of the high frequency power amplifier to obtain the corresponding frequency range of the high frequency power amplifier.

When it acquires the initialization configuration parameters and the identification information of the high frequency power amplifier, the identification information of the mid frequency power amplifier, and the identification information of the low frequency power amplifier, the CPU may initialize first the low frequency power amplifier and then the mid frequency power amplifier and finally the high frequency power amplifier, in accordance with the preset initialization sequence. In particular, the CPU may extract among the said configuration parameters the configuration parameters of the low frequency power amplifier according to the device address C of the low frequency power amplifier and load the configuration parameters of the low frequency power amplifier through the I2C bus to the low frequency power amplifier, so as to obtain the corresponding frequency range of the low frequency power amplifier. Then the CPU may extract among the said configuration parameters the configuration parameters of the mid frequency power amplifier according to the device address B of the mid frequency power amplifier and load the configuration parameters of the mid frequency power amplifier through the I2C bus to the mid frequency power amplifier, so as to obtain the corresponding frequency range of the mid frequency power amplifier. And finally, the CPU may extract among the said configuration parameters the configuration parameters of the high frequency power amplifier and load the configuration parameters of the high frequency power amplifier through the I2C bus to the high frequency power amplifier, so as to obtain the corresponding frequency range of the high frequency power amplifier. The initialization sequence of the high frequency power amplifier, the mid frequency power amplifier, and the low frequency power amplifier by the CPU is not limited to the sequence described above. Alternatively, for example, the high frequency power amplifier can be first initialized, then the mid frequency power amplifier can be initialized, and finally the low frequency power amplifier would be initialized.

According to the solution of the present embodiment, the respective power amplifiers can be initialized according to the identification information of the power amplifiers and the acquired configuration parameters so as to obtain the corresponding frequency range of each of the power amplifiers. Then the acquired audio data would be transferred to the respective power amplifiers, so that each of the power amplifiers can receive the audio data and perform digital-to-analog conversion of the audio data according to the corresponding frequency range and consequently output the digital-to-analog converted audio data to the corresponding speaker. Thus, the audio data of different frequency ranges can converted from digital to analog and amplified by a plurality of power amplifiers and then outputted to the corresponding speakers, enabling wider frequency response of the digital TV audio system and better sound quality. In addition, the external subwoofer would not be needed for the bass, which therefore saves the cost.

Figure 2:
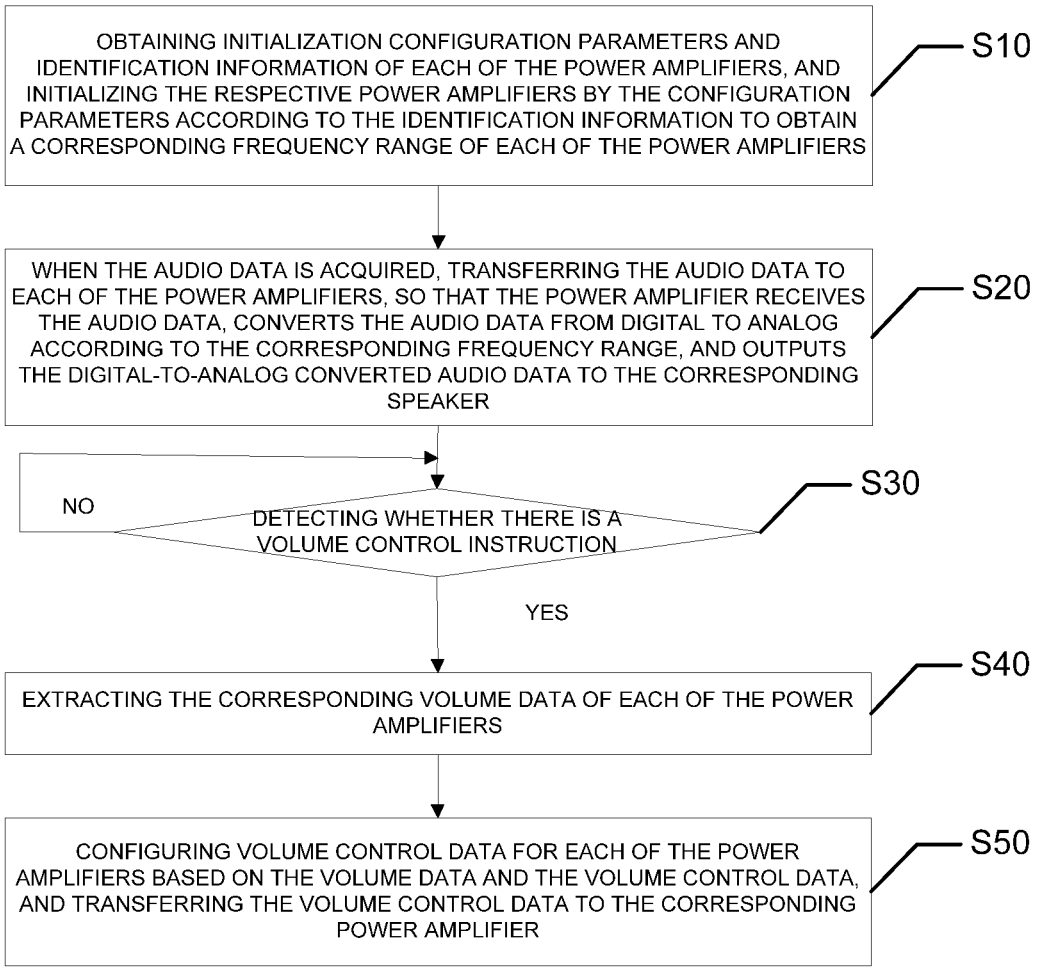
FIG. 2 shows a flowchart illustrating a second embodiment of a method of controlling an audio system according to the present disclosure.

FIG. 2 shows a flowchart illustrating a second embodiment of a method of controlling an audio system according to the present disclosure, which is based on the first embodiment of the method of controlling an audio system.

The method of the present embodiment may further include the following blocks after S20.

In S30, the method may include detecting whether there is a volume control instruction. The method then may proceed to S40.

In S40, the method may include extracting the corresponding volume data of the respective power amplifiers, if there is a volume control instruction.

After it transmits the audio data to the respective power amplifiers, the CPU may detect whether there exists a volume control instruction. If there is detected a volume control instruction, then the CPU may extract the corresponding volume data of the respective power amplifiers; otherwise if there is detected no volume control instruction, then the CPU may continue detecting whether there is issued a volume control instruction. For example, the corresponding volume of the digital television may lie in the range of 0 to 100, while the corresponding volume range of the digital television audio system may be 0 to 255. When the CPU detects the volume control instruction and extracts the corresponding digital television volume data of the low frequency power amplifier to be in the range of 0 to 33, then the corresponding volume data of the digital television audio system would range from 0 to 85. Likewise, when the extracted corresponding digital television volume data of the mid frequency power amplifier ranges from 34 to 67, then the corresponding volume data of the digital television audio system would be in the range of 86 to 170. When the extracted corresponding digital television volume data of the high frequency power amplifier ranges from 68 to 100, then the corresponding volume data of the digital television audio system would be in the range of 171 to 225. The method may then continue to S50.

In S50, the method may include configuring volume control data for the respective power amplifiers based on the volume data and the volume control instruction, and transferring the volume control data to the respective power amplifiers.

The CPU may configure volume control data for the respective power amplifiers based on the volume data and the volume control instruction, and further transfer the volume control data through the I2C interface to the respective power amplifiers, so each of the power amplifiers would convert from digital to analog and amplify the volume control data and further output the amplified volume control data to the corresponding speaker. If the volume control instruction detected by the CPU specifies to adjust the volume of the digital television from 30 to 35, then the CPU may analyze the volume control instruction and compare the volume control instruction with the corresponding digital television volume data of the respective power amplifiers and the volume data of the digital television audio system, so as to obtain from the volume control instruction the volume control data belonging to the low frequency range, the volume control data belonging to the mid frequency range, and the volume control data belonging to the high frequency range. The CPU may deploy through the I2C interface the volume control data of the low frequency range for the low frequency power amplifier, so that the low frequency power amplifier may convert from digital to analog and amplify the volume control data of the low frequency range and further output the amplified volume control data to the subwoofer. In similar fashion, the CPU may deploy through the I2C interface the volume control data of the mid frequency range to the mid frequency power amplifier, so that the mid frequency power amplifier may convert from digital to analog and amplify the volume control data of the mid frequency range and further output the amplified volume control data to the mid and high frequency speaker. Also, the CPU may further deploy through the I2C interface the volume control data of the high frequency range to the high frequency power amplifier, so that the high frequency power amplifier may convert from digital to analog and amplify the volume control data of the high frequency range and further output the amplified volume control data to the mid and high frequency speaker.

In the present embodiment, when the volume control instruction is detected, the volume control data is deployed for each power amplifier in accordance with the volume control instruction, thereby the sound quality of the audio outputted by the digital television audio system is improved and the user experience is enhanced.

An apparatus for controlling an audio system is also provided by the present disclosure.

Figure 3:
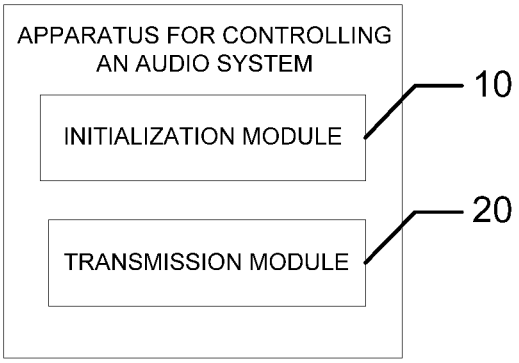
FIG. 3 shows a block diagram illustrating a first embodiment of an apparatus for controlling an audio system according to the present disclosure.

FIG. 3 shows a block diagram illustrating a first embodiment of an apparatus for controlling an audio system according to the present disclosure.

The audio system control apparatus of the present embodiment may include an initialization module 10 and a transmission module 20.

The initialization module 10 may be configured to obtain initialization configuration parameters and identification information of each power amplifier, and initialize the respective power amplifiers by the configuration parameters according to the identification information so as to obtain a corresponding frequency range of each of the power amplifiers.

The CPU (Central Processing Unit) of the digital TV audio system may obtain the initialization configuration parameters and the identification information of each of the power amplifiers and load the configuration parameters to the respective power amplifiers through the audio data interface according to the identification information, so as to initialize the respective power amplifiers to obtain the corresponding frequency range of each of the power amplifiers. The digital TV audio system may include a main IC (integrated circuit), power amplifiers, speakers, a power supply, etc. The main IC in the present embodiment may be the CPU, which may include an I2C (Inter-Integrated Circuit) bus and an I2S (Inter-IC Sound) bus, where the I2S bus can also be called an IC built-in audio bus. The audio data interface may be composed of the I2C bus and the I2S bus in the main IC. It is appreciated that the main IC includes, but is not limited to the I2C bus and the I2S bus. The configuration parameters may include the corresponding equalizer parameters of the respective power amplifiers, the corresponding amplitude limiter parameters of the respective power amplifiers, and the like. The identification information of each of the power amplifiers may be a device address set by the hardware configuration of the power amplifier.

There may be, for example, three speakers in the present embodiment, two of which being mid and high frequency speakers, the other one being a subwoofer. Of the two mid and high frequency speakers, one may be applied for the left channel audio data, while the other applied for the right channel audio data. On the other hand, there may be three power amplifiers in the digital television, including a high frequency power amplifier, a mid frequency power amplifier, and a low frequency power amplifier. The high frequency power amplifier may be coupled both to the left channel device and to the right channel device in the speaker. The mid frequency power amplifier may also be coupled both to the left channel device and to the right channel device. The low frequency power amplifier may be coupled to the subwoofer in the speaker. For example, the corresponding device address of the high frequency power amplifier may be A, the corresponding device address of the mid frequency power amplifier may be B, and the corresponding device address of the low frequency power amplifier may be C. In particular, the CPU may extract among the said configuration parameters the configuration parameters of the high frequency power amplifier according to the device address A of the high frequency power amplifier and load the configuration parameters of the high frequency power amplifier through the I2C bus to the high frequency power amplifier. That is, the high frequency power amplifier may be initialized so as to obtain the frequency range of the audio data that can be processed by the high frequency power amplifier, which is actually the corresponding frequency range of the high frequency power amplifier. For instance, the corresponding audio data frequency range of the high frequency power amplifier may be higher than 1.5 KHz. Likewise, the CPU may extract among the said configuration parameters the configuration parameters of the mid frequency power amplifier according to the device address B of the mid frequency power amplifier and load the configuration parameters of the mid frequency power amplifier through the I2C bus to the mid frequency power amplifier. That is, the mid frequency power amplifier may be initialized so as to obtain the frequency range of the audio data that can be processed by the mid frequency power amplifier, which is actually the corresponding frequency range of the mid frequency power amplifier. For example, the corresponding audio data frequency range of the mid frequency power amplifier may be 140 Hz to 1.5 KHz. Also, according to the device address C of the low frequency power amplifier, the CPU may extract, among the said configuration parameters, the configuration parameters of the low frequency power amplifier and load the configuration parameters of the low frequency power amplifier through the I2C bus to the low frequency power amplifier. That is, the low frequency power amplifier may be initialized to obtain a frequency range of the audio data that can be processed by the low frequency power amplifier, which is the corresponding frequency range of the low frequency power amplifier. For instance, the corresponding audio data frequency range of the low frequency power amplifier may be 0 Hz to 160 Hz.

The transmission module 20 may be configured to transfer the audio data to the respective power amplifiers when the audio data is acquired, so each of the power amplifiers may convert the audio data from digital to analog according to the corresponding frequency range and output the digital-to-analog converted audio data to the corresponding speaker.

When the CPU acquires the audio data, the CPU may transmit the audio data to the respective power amplifiers via the I2S bus for receiving the audio data by the respective power amplifiers. When they receive the audio data transmitted by the CPU, the respective power amplifiers may perform digital-to-analog conversion of the audio data according to their respective frequency ranges and output the analog-to-digital converted audio data to the corresponding speakers. That is, the audio data may be amplified and then outputted to the respective speakers. When the high frequency power amplifier receives the audio data transmitted by the CPU, it may extract in the audio data the part of audio data that is higher than 1.5 kHz, and convert from digital to analog the audio data higher than 1.5 kHz to amplify the audio data and further output the amplified audio data to the mid and high frequency speaker. That is, the amplified data may be outputted to the left channel device and the right channel device, so the corresponding audio can be outputted from the mid and high frequency speaker. When the mid frequency power amplifier receives the audio data transmitted by the CPU, it may extract in the audio data the part of audio data that lies in the range of 140 Hz to 2 KHz, and convert from digital to analog the audio data in the range of 140 Hz to 2 KHz and amplify the audio data and further output the amplified audio data to the mid and high frequency speaker. That is, the amplified data may be outputted to the left channel device and the right channel device, so the corresponding audio can be outputted from the mid and high frequency speaker. When the low frequency power amplifier receives the audio data transmitted by the CPU, it may extract in the audio data the part of audio data that lies in the range of 0 Hz to 160 Hz, and convert from digital to analog the audio data in the range of 0 Hz to 160 Hz and amplify the audio data and further output the amplified audio data to the subwoofer. Thus, the subwoofer would output the corresponding audio.

Further, the initialization module 10 may include specifically a first initialization unit, a second initialization unit, and a third initialization unit.

The first initialization unit may be configured to obtain the initialization configuration parameters and the identification information of the high frequency power amplifier, the identification information of the mid frequency power amplifier, and the identification information of the low frequency power amplifier, and so initialize the low frequency power amplifier by the configuration parameters according to the identification information of the low frequency power amplifier so as to obtain the corresponding frequency range of the low frequency power amplifier.

The second initialization unit may be configured to initialize the mid frequency power amplifier by the configuration parameters according to the identification information of the mid frequency power amplifier so as to obtain the corresponding frequency range of the mid frequency power amplifier, after the corresponding frequency range of the low frequency power amplifier has been obtained.

The third initialization unit may be configured to initialize the high frequency power amplifier by the configuration parameters according to the identification information of the high frequency power amplifier so as to obtain the corresponding frequency range of the high frequency power amplifier, after the corresponding frequency range of the mid frequency power amplifier has been obtained.

When it acquires the initialization configuration parameters and the identification information of the high frequency power amplifier, the identification information of the mid frequency power amplifier, and the identification information of the low frequency power amplifier, the CPU may initialize first the low frequency power amplifier and then the mid frequency power amplifier and finally the high frequency power amplifier, in accordance with the preset initialization sequence. In particular, the CPU may extract among the said configuration parameters the configuration parameters of the low frequency power amplifier according to the device address C of the low frequency power amplifier and load the configuration parameters of the low frequency power amplifier through the I2C bus to the low frequency power amplifier, so as to obtain the corresponding frequency range of the low frequency power amplifier. Then the CPU may extract among the said configuration parameters the configuration parameters of the mid frequency power amplifier according to the device address B of the mid frequency power amplifier and load the configuration parameters of the mid frequency power amplifier through the I2C bus to the mid frequency power amplifier, so as to obtain the corresponding frequency range of the mid frequency power amplifier. And finally, the CPU may extract among the said configuration parameters the configuration parameters of the high frequency power amplifier and load the configuration parameters of the high frequency power amplifier through the I2C bus to the high frequency power amplifier, so as to obtain the corresponding frequency range of the high frequency power amplifier. The initialization sequence of the high frequency power amplifier, the mid frequency power amplifier, and the low frequency power amplifier by the CPU is not limited to the sequence described above. Alternatively, for example, the high frequency power amplifier can be first initialized, then the mid frequency power amplifier can be initialized, and finally the low frequency power amplifier would be initialized.

According to the solution of the present embodiment, the respective power amplifiers can be initialized according to the identification information of the power amplifiers and the acquired configuration parameters so as to obtain the corresponding frequency range of each of the power amplifiers. Then the acquired audio data would be transferred to the respective power amplifiers, so that each of the power amplifiers can receive the audio data and perform digital-to-analog conversion of the audio data according to the corresponding frequency range and consequently output the digital-to-analog converted audio data to the corresponding speaker. Thus, the audio data of different frequency ranges can be converted from digital to analog and amplified by a plurality of power amplifiers and then outputted to the corresponding speakers, enabling wider frequency response of the digital TV audio system and better sound quality. In addition, the external subwoofer would not be needed for the bass, which therefore saves the cost.

Figure 4:
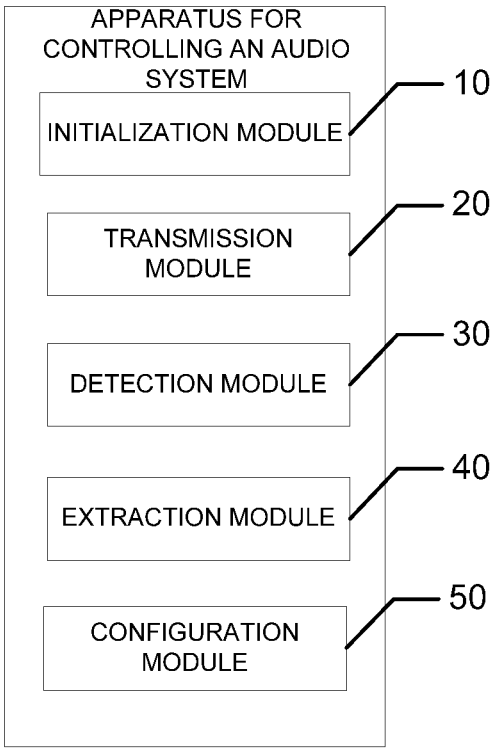
FIG. 4 shows a block diagram illustrating a second embodiment of an apparatus for controlling an audio system according to the present disclosure.

FIG. 4 shows a block diagram illustrating a second embodiment of an apparatus of controlling an audio system according to the present disclosure, which is based on the first embodiment of the apparatus of controlling an audio system.

The audio system control apparatus of the present embodiment may in addition include a detection module 30, an extraction module 40, and a configuration module 50.

The detection module 30 may be configured to detect whether there is a volume control instruction.

The extraction module 40 may be configured to extract the corresponding volume data of the respective power amplifiers, if there is a volume control instruction.

After it transmits the audio data to the respective power amplifiers, the CPU may detect whether there exists a volume control instruction. If there is detected a volume control instruction, then the CPU may extract the corresponding volume data of the respective power amplifiers; otherwise if there is detected no volume control instruction, then the CPU may continue detecting whether there is issued a volume control instruction. For example, the corresponding volume of the digital television may lie in the range of 0 to 100, while the corresponding volume range of the digital television audio system may be 0 to 255. When the CPU detects the volume control instruction and extracts the corresponding digital television volume data of the low frequency power amplifier to be in the range of 0 to 33, then the corresponding volume data of the digital television audio system would range from 0 to 85. Likewise, when the extracted corresponding digital television volume data of the mid frequency power amplifier ranges from 34 to 67, then the corresponding volume data of the digital television audio system would be in the range of 86 to 170. When the extracted corresponding digital television volume data of the high frequency power amplifier ranges from 68 to 100, then the corresponding volume data of the digital television audio system would lie in the range of 171 to 225.

The configuration module 50 may be configured to configure volume control data for the respective power amplifiers based on the volume data and the volume control instruction, and transfer the volume control data to the respective power amplifiers.

The CPU may configure volume control data for the respective power amplifiers based on the volume data and the volume control instruction, and further transfer the volume control data through the I2C interface to the respective power amplifiers, so each of the power amplifiers would convert from digital to analog and amplify the volume control data and further output the amplified volume control data to the corresponding speaker. If the volume control instruction detected by the CPU specifies to adjust the volume of the digital television from 30 to 35, then the CPU may analyze the volume control instruction and compare the volume control instruction with the corresponding digital television volume data of the respective power amplifiers and the volume data of the digital television audio system, so as to obtain from the volume control instruction the volume control data belonging to the low frequency range, the volume control data belonging to the mid frequency range, and the volume control data belonging to the high frequency range.

The CPU may deploy through the I2C interface the volume control data of the low frequency range for the low frequency power amplifier, so that the low frequency power amplifier may convert from digital to analog and amplify the volume control data of the low frequency range and further output the amplified volume control data to the subwoofer. In similar fashion, the CPU may deploy through the I2C interface the volume control data of the mid frequency range to the mid frequency power amplifier, so that the mid frequency power amplifier may convert from digital to analog and amplify the volume control data of the mid frequency range and further output the amplified volume control data to the mid and high frequency speaker. Also, the CPU may further deploy through the I2C interface the volume control data of the high frequency range to the high frequency power amplifier, so that the high frequency power amplifier may convert from digital to analog and amplify the volume control data of the high frequency range and further output the amplified volume control data to the mid and high frequency speaker.

In the present embodiment, when the volume control instruction is detected, the volume control data is deployed for each power amplifier in accordance with the volume control instruction, thereby the sound quality of the audio outputted by the digital television audio system is improved and the user experience is enhanced.

It is to be noted that the term "including", "comprising", or any other variation thereof is intended to encompass a non-exclusive inclusion herein so that a process, method, article, or device including/comprising a set of elements includes not only the stated elements, but other elements not expressly listed, or elements inherent to such processes, methods, articles, or devices. In the absence of further limitations, the elements defined by the phrase "including/comprising one . . . " do not preclude the presence of additional identical elements in the process, method, article, or apparatus that includes the element.

The embodiments of the present disclosure have been described for purposes of illustration only and are not to be intended as limiting the scope of the disclosure.

It will be apparent to those skilled in the art from the foregoing description that the embodiments described above may be implemented by means of software plus the necessary general-purpose hardware platform. Although the embodiments described above may also be implemented by hardware, the former would be advantageous in many cases. On the basis of such an understanding, the substantial technical solution, or the part which contributes to the prior art, or all or part of the technical solution, of the disclosure, may be embodied as software products. Computer software products can be stored in a storage medium, e.g., ROM/RAM, magnetic disk, or optical disk, and can include multiple instructions causing a computing device, e.g., a mobile phone, a computer, a server, a conditioner, a network device, etc., to execute all or part of the methods as described herein in various embodiments.

Furthermore, it is apparent to those skilled in the art that the present disclosure also provides an apparatus for controlling an audio system, the apparatus comprising a non-transitory program storage medium and one or more processors. The non-transitory program storage medium stores program code executable by the processor(s) to perform the methods as described above. Furthermore, it is apparent to those skilled in the art that various units or modules 10, 20, 30, 40, and 50, as shown in FIGS. 3-4, can be software modules or software units. In another aspect, it is well-known that various software modules or software units inherently can be stored in the non-transitory program storage medium and executed by the processor(s).

The foregoing specification merely depicts some exemplary embodiments of the present disclosure and therefore is not intended as limiting the scope of the disclosure. Any equivalent structural or flow transformations made to the disclosure, or any direct or indirect applications of the disclosure on any other related fields, shall all fall in the protection of the disclosure.

We claim:

1. A method of controlling an audio system that comprises at least two power amplifiers, the method comprising:

obtaining initialization configuration parameters and identification information of each of the power amplifiers, and initializing the respective power amplifiers by the configuration parameters according to the identification information to obtain a corresponding frequency range of each of the power amplifiers; and when audio data is acquired, transferring the audio data to the respective power amplifiers, and converting, by each of the power amplifiers, the audio data from digital to analog according to the corresponding frequency range and outputting the digital-to-analog converted audio data to a corresponding speaker.

2. The method according to claim 1, wherein the audio system comprises three power amplifiers including a high frequency power amplifier, a mid frequency power amplifier, and a low frequency power amplifier, wherein the high frequency power amplifier is coupled to a left channel device and to a right channel device, the mid frequency power amplifier is coupled to the left channel device and to the right channel device, and the low frequency power amplifier is coupled to a subwoofer.

3. The method according to claim 2, wherein obtaining the initialization configuration parameters and the identification information of each power amplifier and initializing the respective power amplifiers by the configuration parameters comprises:

obtaining the initialization configuration parameters and the identification information of the high frequency power amplifier, the identification information of the mid frequency power amplifier, and the identification information of the low frequency power amplifier, and initializing the low frequency power amplifier by the configuration parameters according to the identification information of the low frequency power amplifier to obtain a corresponding frequency range of the low frequency power amplifier;

after the corresponding frequency range of the low frequency power amplifier is obtained, initializing the mid frequency power amplifier by the configuration parameters according to the identification information of the mid frequency power amplifier to obtain a corresponding frequency range of the mid frequency power amplifier; and after the corresponding frequency range of the mid frequency power amplifier is obtained, initializing the high frequency power amplifier by the configuration parameters according to the identification information of the high frequency power amplifier to obtain a corresponding frequency range of the high frequency power amplifier.

4. The method according to claim 1, further comprising, subsequent to transferring the audio data to the respective power amplifiers and converting, by each of the power amplifiers, the audio data and outputting the digital-m-analog converted audio data to the corresponding speaker:

detecting whether there is a volume control instruction;

if there is a volume control instruction, extracting the corresponding volume data of the respective power amplifiers; and configuring volume control data for the respective power amplifiers based on the volume data and the volume control instruction, and transferring the volume control data to the respective power amplifiers.

5. The method according to claim 4, further comprising, subsequent to detecting whether there is a volume control instruction:

if there is detected no volume control instruction, detecting still whether there is issued a volume control instruction.

6. The method according to claim 2, further comprising, subsequent to transferring the audio data to the respective power amplifiers, and converting, by each of the power amplifiers, the audio data and outputting the digital-to-analog converted audio data to the corresponding speaker:

detecting whether there is a volume control instruction;

if there is a volume control instruction, extracting the corresponding volume data of the respective power amplifiers; and configuring volume control data for the respective power amplifiers based on the volume data and the volume control instruction, and transferring the volume control data to the respective power amplifiers.

7. The method according to claim 6, further comprising, subsequent to detecting whether there is a volume control instruction:

if there is detected no volume control instruction, detecting still whether there is issued a volume control instruction.

8. The method according to claim 3, further comprising, subsequent to transferring the audio data to the respective power amplifiers, and converting, by each of the power amplifiers, the audio data and outputting the digital-to-analog converted audio data to the corresponding speaker:

detecting whether there is a volume control, instruction;

if there is a volume control instruction, extracting the corresponding volume data of the respective power amplifiers; and configuring volume control data for the respective power amplifiers based on the volume data and the volume control instruction, and transferring the volume control data to the respective power amplifiers.

9. The method according to claim 8, further comprising, subsequent to detecting whether there is a volume control instruction:

if there is detected no volume control instruction, detecting still whether there is issued a volume control instruction.

10. An apparatus for controlling an audio system that comprises at least two power amplifiers, the apparatus comprising at least one processor and a non-transitory program storage medium containing program code executable by the at least one processor, the program code comprising:

an initialization module configured to obtain initialization configuration parameters and identification information of each of the power amplifiers, and initialize the respective power amplifiers by the configuration parameters according to the identification information to obtain a corresponding frequency range of each of the power amplifiers; and a transmission module configured to transfer audio data, when acquired, to the respective power amplifiers, so that each of the power amplifiers converts the audio data from digital to analog according to the corresponding frequency range and outputs the digital-to-analog converted audio data to a corresponding speaker.

11. The apparatus according, to claim 10, wherein the audio system comprises three power amplifiers including a high frequency power amplifier, a mid frequency power amplifier, and a low frequency power amplifier, wherein the high frequency power amplifier is coupled to a left channel device and to a right channel device, the mid frequency power amplifier is coupled to the left channel device and to the right channel device, and the low frequency power amplifier is coupled to a subwoofer.

12. The apparatus according to claim 11, wherein the initialization module comprises:

a first initialization unit configured to obtain the initialization configuration parameters and the identification information of the high frequency power amplifier, the identification information of the mid frequency power amplifier, and the identification information of the low frequency power amplifier, and initialize the low frequency power amplifier by the configuration parameters according to the identification information of the low frequency power amplifier to obtain a corresponding frequency range of the low frequency power amplifier;

a second initialization unit configured to initialize the mid frequency power amplifier by the configuration parameters according to the identification information of the mid frequency power amplifier to obtain a corresponding frequency range of the mid frequency power amplifier, after the corresponding frequency range of the low frequency power amplifier is obtained; and a third initialization unit configured to initialize the high frequency power amplifier by the configuration parameters according to the identification information of the high frequency power amplifier to obtain a corresponding frequency range of the high frequency power amplifier, after the corresponding frequency range of the mid frequency power amplifier is obtained.

13. The apparatus according to claim 10, wherein the program code further comprises:

a detection module configured to detect whether there is a volume control instruction;

an extraction module configured to extract the corresponding volume data of the respective power amplifiers, if there is a volume control instruction; and a configuration module configured to configure volume control data for the respective power amplifiers based on the volume data and the volume control instruction, and transfer the volume control data to the respective power amplifiers.

14. The apparatus according to claim 13, wherein the program code further comprises a processing module configured to detect still whether there is issued a volume control instruction if there is detected no volume control instruction.

15. The apparatus according to claim 11, wherein the program code further comprises:

a detection module configured to detect whether there is a volume control instruction;

an extraction module configured to extract the corresponding volume data of the respective power amplifiers, if there is a volume control instruction; and a configuration module configured to configure volume control data for the respective power amplifiers based on the volume data and the volume control instruction, and transfer the volume control data to the respective power amplifiers.

16. The apparatus according to claim 15, wherein the program code further comprises a processing module configured to detect still whether there is issued a volume control instruction if there is detected no volume control instruction.

17. The apparatus according to claim 12, wherein the program code further comprises:

a detection module configured to detect whether there is a volume control instruction;

an extraction module configured to extract the corresponding volume data of the respective power amplifiers, if there is a volume control instruction; and a configuration module configured to configure volume control data for the respective power amplifiers based on the volume data and the volume control instruction, and transfer the volume control data to the respective power amplifiers.

18. The apparatus according to claim 17, wherein the program code further comprises a processing module configured to detect still whether there is issued a volume control instruction if there is detected no volume control instruction.

* * * * *